United States Patent [19]

Isobe et al.

[11] 4,327,856

[45] May 4, 1982

[54] PAPER TRANSFER SYSTEM IN A PRINTER

[75] Inventors: Minoru Isobe; Etumi Ishii; Shuichi Imai, all of Tokyo; Tadasi Kodama, Sakura; Wataru Ohara, Yokosuka, all of Japan

[73] Assignees: Oki Electric Industry Co., Ltd.; Nippon Telegraph & Telephone Public Corp., both of Tokyo, Japan

[21] Appl. No.: 148,396

[22] Filed: May 9, 1980

[30] Foreign Application Priority Data

May 22, 1979 [JP] Japan ..... 54/62140

[51] Int. Cl.[3] ..... B65H 17/36

[52] U.S. Cl. ..... 226/162; 226/166

[58] Field of Search ..... 226/74, 112, 158, 162, 226/163–167

[56] References Cited

U.S. PATENT DOCUMENTS

| | | | |
|---|---|---|---|
| 3,825,162 | 7/1974 | Hubbard | 226/74 |
| 4,091,980 | 5/1978 | Gerber | 226/162 |
| 4,119,254 | 10/1978 | Lorenz | 226/162 |
| 4,131,224 | 12/1978 | Gerber et al. | 226/8 |

*Primary Examiner*—Leonard D. Christian

*Attorney, Agent, or Firm*—Armstrong, Nikaido, Marmelstein & Kubovcik

[57] ABSTRACT

A small printer is provided which comprises a housing, a rolled printing paper mounted in the housing, a platen along which a paper runs, a motor, and a carriage having a printing head for mosaic printing on a paper on the platen. The carriage travels along the whole width of the paper and is driven by the motor, and a paper transfer mechanism transfers the paper by one line for every traverse of the carriage. The paper transfer mechanism comprises an idler positioned beneath the path of the paper, the idler being swingable in the moving direction of the paper, and the idler having a first projection parallel to the path of the carriage at the left half of the idler and a second projection inclined to the path of the carriage at the right half thereof. The projections are engaged with the corresponding slots provided at the bottom of the carriage to ensure the swing movement of the idler is synchronized with the movement of the carriage. The idler has a substantially V-shaped friction member providing a large frictional force to the paper in the normal moving direction of the paper and a small frictional force to the paper in the opposite moving direction of the paper.

5 Claims, 10 Drawing Figures

PAPER TRANSFER SYSTEM IN A PRINTER

BACKGROUND OF THE INVENTION

The present invention relates to the paper transfer system of a printer, in particular, relates to such a system which is small in size, simple in structure and is suitable for use in a simple small printer.

The prior paper transfer system of a small printer rotates a gum roller by a motor or a ratchet means, and a paper which contacts with that gum roller is transferred by the friction with that gum roller.

However, said prior paper transfer system has the disadvantages that the size is rather large since the diameter of the gum roller must be larger than a predetermined value, and a motor or a ratchet means must be utilized only for transferring a paper. Further, that prior system has the disadvantage that it is heavy, resulting in the high manufacturing cost.

SUMMARY OF THE INVENTION

It is an object, therefore, of the present invention to overcome the disadvantages and limitations of a prior paper transfer system by providing a new and improved paper transfer system for a printer.

It is also an object of the present invention to provide a paper transfer system which is simple in structure and small in size, resulting in the low manufacturing cost.

The above and other objects are attained by a paper transfer system comprising of a housing, a rolled printing paper mounted in the housing, a platen along which a paper runs, a motor, a carriage having a printing head for mosaic printing on a paper on the platen, said carriage travelling along the whole width of the paper driven by said motor, an idler being put beneath the path of the paper, said idler being swingable in the moving direction of the paper, said idler having the first projection parallel to the path of the carriage at the left half of the idler and the second projection inclined to the path of the carriage at the right half of the idler, those projections being engaged with the corresponding slots provided at the bottom of said carriage to ensure the swing movement of the idler synchronized with the movement of the carriage, said idler having a friction means providing a large friction to the paper in the normal moving direction of the paper and a small amount of friction to the same in the opposite moving direction of the paper.

BRIEF DESCRIPTION OF THE DRAWINGS

The foregoing and other objects, features, and attendant advantages of the present invention will become better understood by means of the following description and accompanying drawings wherein.

DESCRIPTION OF THE PREFERRED EMBODIMENTS

Figure 1:
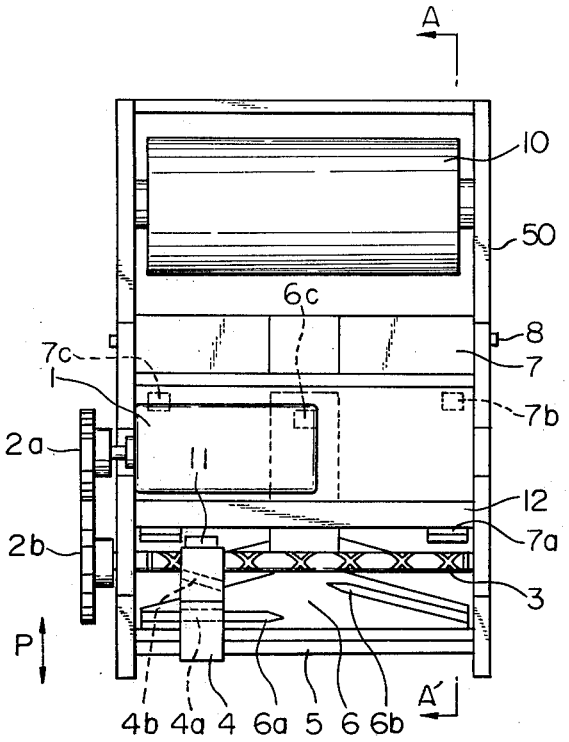
FIG. 1 is the plane view of the printer according to the present invention.
Figure 5:
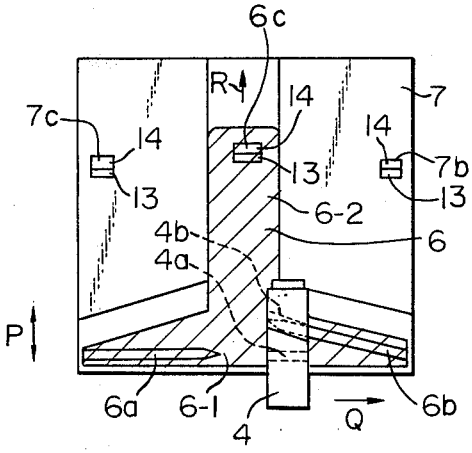
FIG. 5 and FIG. 6 are the explanatory drawings for the explanation of the movement of an idler.
Figure 6:
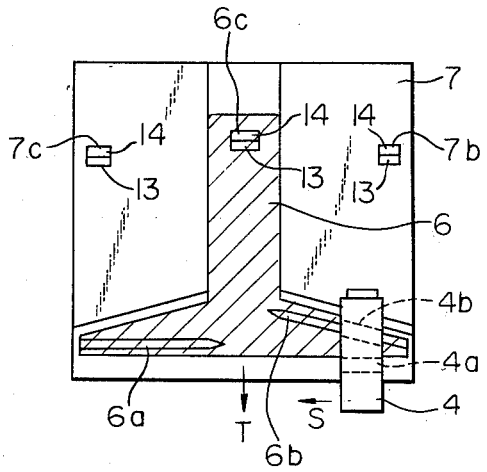

FIG. 1 shows the plane view of the printer including the paper transfer system according to the present invention. In FIG. 1, the reference numeral 1 is a motor, 2*a* and 2*b* are gears engaged with each other and are rotated by said motor 1, 3 is a spindle having a screw slot in both the clockwise direction and the counterclockwise direction and said spindle 3 is fixed to said gear 2*b*. The screw slot in the clockwise direction is coupled with the other screw slot of the counterclockwise direction at both the extreme ends of the spindle 3. The reference numeral 4 is a carriage for mounting a printer head 11, and said carriage 4 has a projection (not shown) which engages with one of the screw slots on said spindle 3, and said carriage 4 has also a pair of slots 4*a* and 4*b* at the bottom of the carriage. The former slot 4*a* is parallel to the spindle 3, and the latter slot 4*b* is inclined to said spindle 3. A printer head mounted on the carriage 4 may be a dot matrix printer for mosaic printing having a plurality of (for instance seven) dots which are selectively activated according to the desired pattern to be printed. The printer head disclosed in the U.S. Pat. No. 3,896,918 can be utilized as the printer head mounted on said carriage 4, alternatively, a thermal printer head which has a plurality of small thermal elements can be utilized as the printer head. In case of a thermal printer head, the printing paper is a treated thermal paper which is colored by heating the same by said thermal elements selectively. The reference numeral 5 is a guide shaft provided parallel to the spindle 3 for guiding the carriage 4 along the spindle 3. The reference numeral 6 is an idler, and said idler 6 is slidable in the perpendicular direction (the direction as shown by the arrow P in FIG. 1, FIG. 2 and FIG. 5) to the spindle 3. According to the preferred embodiment of the present invention, said idler 6 is a T-shaped plate as shown in FIG. 1, FIG. 5 and FIG. 6, having the first arm 6-1 parallel to the spindle 3, and the second arm 6-2 perpendicular to the spindle 3 (see FIG. 5), and said idler 6 has the first projection 6*a* parallel to the spindle 3 at the left half portion of the first arm 6-1, and the second projection 6*b* which is inclined to the spindle 3 at the right half portion on the first arm 6-1. The inclined projection 6*b* is so inclined that the left extreme end of the same is close to the spindle 3 and the right extreme end of the same is far from the spindle 3 (see FIG. 1). Further, the inclined projection 6*b* is substantially parallel to the inclined slot 4*b* on the bottom of the carriage 4 so that projection 6*b* can engage with the slot 4*b*. The idler 6 has also a friction means 6*c* (see FIG. 5 and FIG. 6) near the end of the second arm 6-2. Preferably, the friction by said friction means 6*c* in one direction is different from that in the opposite direction due to the particular structure of the friction means 6*c* as mentioned later.

Figure 2:
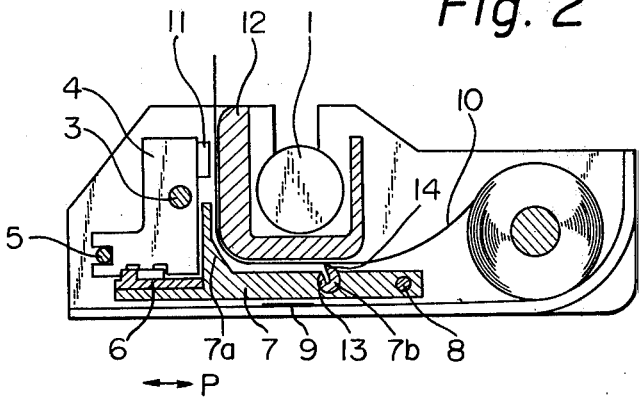
FIG. 2 is the cross sectional view at the line A—A' of FIG. 1.

The reference numeral 7 is a guide plate provided on the bottom of the housing 50 so that said guide plate 7 can be pivotable around the axis 8. The guide plate 7 has a pair of paper guides 7*a* projected perpendicular at both the extreme ends of the guide plate 7. Preferably, the guide plate 7 has a T-shaped slot for receiving said T-shaped idler 6, and the idler 6 is put in the slot of the guide plate so that the idler 6 can slide in the direction P in the slot of the guide plate 7. The guide plate 7 has a pair of friction means 7*b* and 7*c* as shown in FIG. 1, and preferably, the friction by said friction means 7*b* and 7c depend upon the direction. The reference numeral 8 is an axis for pivotably mounting said guide plate 7. The reference numeral 9 is a plate spring for urging the guide plate 7 in the upward direction, 10 is a rolled printing paper mounted in the housing 50. The reference numeral 11 is a printer head for mosaic printing, 12 is a U-shaped paper guide fixed to the housing 50, and the thin paper path is provided between the paper guide 12 and said guide plate 7 (or the idler 6) as shown in FIG. 2. The portion of the paper guide 12 confronting with the printer head 11 operates as a platen. Thus, the paper runs from the rolled paper 10 through that thin paper path between the paper guide 12 and the guide plate 7 to outside of the printer, and when the paper runs in front of printer head 11 the printing operation is performed. Further, a friction means 6c on the idler 6 is projected in said paper path in order to transfer the paper by friction in every travel of the carriage.

Now, the operation of the above apparatus is described.

Figure 3:
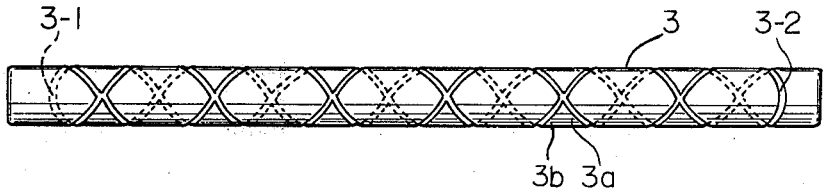
FIG. 3 is a view which shows the structure of the spindle 3 of FIGS. 1 and 2.

When the motor 1 rotates the first gear 2a, the second gear 2b which is engaged with the first gear 2a is rotated and the spindle 3 which is fixed to the second gear 2b is also rotated. The spindle 3 has a pair of screw slits 3a and 3b which are coupled with each other at both the ends 3-1 and 3-2 of the spindle 3 as shown in FIG. 3. The projection (not shown) provided on the carriage 4 is engaged with that screw slit. Accordingly, when the spindle 3 rotates in one direction, the carriage 4 engaged with the slit of the spindle 3 is moved along the spindle 3 and the guide shaft 5 in one direction (left or right), and when the carriage 4 reaches the extreme end of the spindle 3, the projection (not shown) of the carriage 4 is engaged with the other screw slit and moves in the opposite direction. Thus, the carriage 4 moves in both the direction linearly guided by the guide 5 according to the rotation of the spindle 3. When the carriage 3 moves from the left end to the right end, the printer head mounted on the carriage prints the desired pattern on the paper 10, and when the carriage 4 moves from the right end to the left end, the paper 10 is transferred by one line. The operation for transferring paper is as follows.

Figure 4:
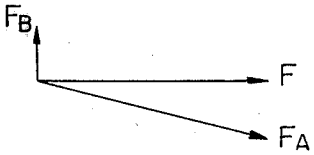
FIG. 4 is a view which shows the vector for the explanation of the swing movement of an idler.

When the carriage 4 stands at the left end of the spindle as shown in FIG. 1, the first slot 4a which is provided at the bottom of the carriage 4 parallel to the spindle 3 is engaged with the first projection 6a which is parallel to the spindle 3. When the carriage 4 moves in the right direction and reaches the middle of the path, the slot 4a of the carriage 4 does not engage with the projection 6a anymore, and instead, the second slot 4b which is substantially parallel to the second projection 6b is engaged with the second projection 6b which is also inclined to the spindle 3. When the carriage 4 moves further in the right direction, the projection 6b of the idler 6 is pushed by the slot 4b of the carriage 4 in the moving direction of the carriage 4. The force F of that push can be divided to the first component $F_A$ which is parallel to the slot 4b of the carriage 4, and the second component $F_B$ which is in the direction of the moving direction of a paper as shown in FIG. 4. In this case, it should be noted that the idler 6 is slidable on the guide plate 7 in the direction P of FIG. 5. Therefore, when the carriage 4 is moving from the middle of the path of the right end as shown by the arrow Q in FIG. 5, the idler 6 is pushed by the second component $F_B$ in the direction R of FIG. 5. That direction R is opposite to the normal moving direction of a paper.

By the way, a paper touches with friction means 6c on the idler 6, and the friction means 7b and 7c on the guide plate 7. When the idler 6 moves in the direction R of FIG. 5, the friction between the friction means 6c and a paper is small, and so a paper does not follow to the movement of the idler 6 but remains stopped. The friction means 7b and 7c on the guide plate 7 prevent also the movement of a paper in the direction R when the idler moves in that direction.

Next, when the carriage 4 is moving in the direction S of FIG. 6 from right to left, after the carriage reaches the extreme right end of the path, the projection 6b of the idler 6 is pushed by the slot 4b of the carriage 4 in the moving direction of the carriage 4. The force F′ in this case is in the opposite direction of that of the force F of the case of FIG. 5, therefore, the idler 6 moves in the direction T of FIG. 6 when the carriage 4 moves in the direction S of FIG. 6. In this case, the friction means 6c on the idler 6 pushes a paper in the direction T by friction between said friction means 6c and a paper, when the idler 6 moves in the direction T. In this case, the friction by friction means 7b and 7c on the guide plate 7 is smaller than that by friction means 6c. Therefore, when the idler 6 moves in the direction T, a paper is moved also in the direction T by the length equal to the movement of the idler 6.

In summarizing the above operation, when the carriage 4 moves in the direction of the printing line in both way, the idler 6 moves in the perpendicular direction to that printing line, or the moving direction of a paper. And, when the carriage 4 returns to the initial position, or the idler 6 moves in the direction T of FIG. 6, a paper is moved by the predetermined length or the length requested for the printing of one line. By repeating the above operation, a paper is moved by one line every time a carriage finishes each one line printing.

When a paper 10 is not mounted, and a carriage 4 moves in both ways, the friction means 6c might contact directly with the bottom of the U-shaped member 12. In this case, the friction between the friction means and the member 12 might be very large, and that large friction would disturb the operation of the printer, or the movement of the idler 6. In order to solve that problem, the guide plate 7 is pivotably fixed to the axis 8 so that the guide plate 7 rotates against the spring 9 in the counterclockwise direction (see FIG. 2) when that friction is too large, that rotation of the guide plate 7 reduces the friction and facilitates the operation of the printer.

Now, the structure of the friction means 6c, 7b and 7c will be described in accordance with FIGS. 7A, 7B, 7C and 7D. FIG. 7D is the perspective view of the friction means, which is in the cylindrical shape with a sector shaped slit 16. The friction means is made of material having a large amount of friction, like urethane gum or natural gum. The size of each friction means is small, and for instance, the length L is less than 5 mm, and the diameter is less than 3 mm, when the width of a paper is about 10 cm.

Due to the presence of the sector shaped slit 16, each friction means has a fixed portion 13, a spring portion 14 and a support portion 15 connecting both the fixed portion 15 connecting both the fixed portion 13 and the spring portion 14. The angle $\alpha$ of the sector shaped slit or the angle between the fixed portion 13 and the spring portion 14 can vary by pushing the spring portion 14 towards the fixed portion. Preferably, the spring portion 14 is divided in to a plurality of portions separated from one another by a thin slit 17.

Figures 7A, 7B, 7C:
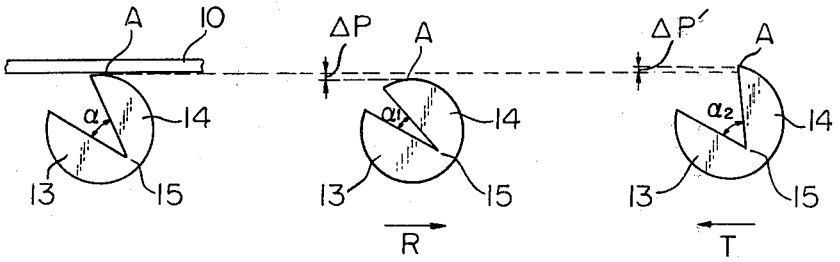
FIG. 7A, FIG. 7B, FIG. 7C and FIG. 7D are views which show a structure and operation of a friction means.
Figure 7D:
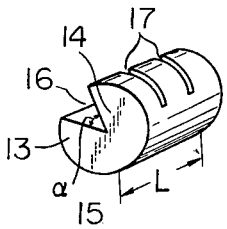

In FIGS. 7A through 7C, a paper 10 contacts with the friction means at the point A which is on the spring portion 14 near the edge of the same.

When the friction means moves in the direction R as shown in FIG. 7B, the angle $\alpha_1$ between the fixed portion 13 and the spring portion 14 is smaller than the angle $\alpha$ of FIG. 7A in which the friction means stops, and therefore, the top point A on the spring portion 14 is lowered by the length $\Delta P$ compared with the position when the friction means stops as shown in FIG. 7B. Accordingly, the friction between the friction means and a paper in the case of FIG. 7B is small, and a paper does not move in spite of the movement of the friction means in the direction R.

On the other hand, when the friction means moves in the direction T as shown in FIG. 7C, the angle $\alpha_2$ between the fixed portion and the spring portion becomes larger than that of the case of FIG. 7A because of the friction itself between the friction means and the paper. Therefore, the top point A on the spring portion 14 is raised by $\Delta P'$ compared with the position of FIG. 7A where the friction means is stopped. Accordingly, the friction between the friction means and a paper in the case of FIG. 7C is large, and a paper moves following the movement of the friction means.

Accordingly, it should be appreciated that the friction between the friction means and a paper depends upon the moving direction of the friction means and/or the paper due to the particular structure of the friction means shown in FIGS. 7A through 7D.

Each friction means 6*c*, 7*b* and 7*c* are installed on the idler 6, and the guide plate 7 so that the upper portion or the spring portion 14 is at the upstream along the paper path, and the lower portion or the fixed portion 13 is at the downstream along the paper path as shown in FIGS. 2, 5 and 6. Also, the height of three friction means 6*c*, 7*b* and 7*c* is supposed to be the same as one another to assure the contact with the paper at the same time. In those configurations, when the idler 6 moves in the direction T of FIG. 6, the relation between the friction means 6*c* and the paper is shown in FIG. 7C and the friction between the two is large, then, the paper is transferred in the direction T following the idler 6. In this case, the relation between the friction means 7*b* and 7*c*, and the paper is shown in FIG. 7B, and the friction between those friction means and the paper is small. Therefore, the friction by the friction means 6*c* is larger than that by the friction means 7*b* and 7*c*.

On the other hand, when the idler 6 moves in the direction R of FIG. 5, the friction by the friction means 6*c* is small, and the friction by the friction means 7*b* and 7*c* is large. Therefore, the paper does not move.

It should be appreciated that the structure of the friction means is not restricted to the shape as shown in FIGS. 7A through 7D, but a V-shaped friction material can be utilized for that purpose. Further, the friction means 7*b* and 7*c* do not necessarily depend upon the direction, but an ordinary friction means having the same friction in both the directions can be utilized for the friction means 7*b* and 7*c*. Further, the fixed friction means 7*b* and 7*c* can be mounted on the platen 12, instead of the guide plate 7.

As described above in detail, according to the present invention, an idler swings synchronized with the round trip of a carriage, and a friction means mounted on the idler transfers a printing paper by one line whenever the carriage is in the return path. Accordingly, the structure of the present printer is simple, and the size of the printer is small. Further, no ratchet means, no motor nor gum roller for merely transferring a paper is necessary, thus, a printer with a light weight and low price can be obtained.

From the foregoing it will now be apparent that a new and improved paper transfer system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. In a printer having a housing, a rolled paper mounted in the housing, a platen along which a paper runs, a motor, a carriage having a printing head for printing on a paper on the platen, coupling means for operably coupling said motor to said carriage, wherein said carriage is driven along the whole width of the paper by said motor through said coupling means, and a paper transfer means for transferring the paper by one line for every traverse of said carriage, characterized in that said paper transfer means comprises an idler positioned beneath the path of the paper, said idler being swingable in the moving direction of the paper, said idler having a first projection parallel to the path of the carriage and a second projection inclined to the path of the carriage, those projections being shorter than half of the travelling length of the carriage, those projections engaging with the corresponding slots provided at the bottom of said carriage to ensure the swing movement of the idler synchronized with the movement of the carriage, said idler having a friction means providing a greater frictional force to the paper in the normal moving direction of the paper and a smaller frictional force to the same in the opposite moving direction of the paper.

2. The invention as defined in claim 1 wherein said friction means is substantially V-shaped and is mounted so that the open end of the V-shaped structure is towards the moving direction of the paper.

3. The invention as defined in claim 2, wherein said friction means has a circular cylindrical shape with a sector shaped slit.

4. The invention as defined in claim 1, wherein said first projection on the idler is in the left half of the idler, and the second projection on the idler is in the right half of the idler.

5. The invention as defined in claim 1, further comprising a fixed friction means contacting with the paper.

* * * * *